US008845237B2

(12) United States Patent
Freitag

(10) Patent No.: US 8,845,237 B2
(45) Date of Patent: Sep. 30, 2014

(54) METHOD FOR MODIFYING A REINFORCED SOIL STRUCTURE

(75) Inventor: Nicolas Freitag, Orsay (FR)

(73) Assignee: Terre Armee Internationale, Velizy Villacoublay (FR)

( * ) Notice: Subject to any disclaimer, the term of this patent is extended or adjusted under 35 U.S.C. 154(b) by 0 days.

(21) Appl. No.: 13/997,184

(22) PCT Filed: Dec. 22, 2011

(86) PCT No.: PCT/FR2011/053166

§ 371 (c)(1),
(2), (4) Date: Jun. 21, 2013

(87) PCT Pub. No.: WO2012/085486

PCT Pub. Date: Jun. 28, 2012

(65) Prior Publication Data

US 2013/0294846 A1 Nov. 7, 2013

(30) Foreign Application Priority Data

Dec. 23, 2010 (FR) ..... 10 61210

(51) Int. Cl.
*E02D 29/02* (2006.01)
*E02D 37/00* (2006.01)

(52) U.S. Cl.
CPC ..... *E02D 37/00* (2013.01); *E02D 29/0241* (2013.01)
USPC ..... 405/262; 405/284

(58) Field of Classification Search
CPC . E02D 29/02; E02D 29/0225; E02D 29/0233; E02D 29/0241
USPC ..... 405/262, 284, 285, 286
See application file for complete search history.

(56) References Cited

U.S. PATENT DOCUMENTS

| | | | | |
|---|---|---|---|---|
| 4,728,225 | A * | 3/1988 | Brandl et al. | 405/262 |
| 4,961,673 | A * | 10/1990 | Pagano et al. | 405/262 |
| 5,368,414 | A * | 11/1994 | Miller | 405/262 |
| 5,551,810 | A * | 9/1996 | Franceski et al. | 405/286 |
| 5,558,470 | A * | 9/1996 | Elmore et al. | 405/262 |
| 5,688,078 | A * | 11/1997 | Hammer | 405/286 |
| 6,802,675 | B2 * | 10/2004 | Timmons et al. | 405/284 |
| 7,425,107 | B2 * | 9/2008 | Derache | 405/262 |
| 2006/0193699 | A1 * | 8/2006 | Freitag et al. | 405/262 |
| 2009/0041552 | A1 | 2/2009 | Hammer | |

FOREIGN PATENT DOCUMENTS

| | | | |
|---|---|---|---|
| EP | 0 290 941 | A1 | 11/1988 |
| FR | 2 860 811 | A1 | 4/2005 |
| FR | 2 913 436 | A1 | 9/2008 |
| WO | WO 97/05335 | A1 | 2/1997 |
| WO | WO 2007/012070 | A2 | 9/2007 |

* cited by examiner

*Primary Examiner* — Frederick L Lagman
(74) *Attorney, Agent, or Firm* — McKenna Long & Aldridge LLP

(57) ABSTRACT

The invention relates to a method for modifying a reinforced soil structure, said structure comprising: a fill, a first facing including an outer face defining the front face of the structure, and at least one stabilization element connected to the first facing and extending in a reinforced area of the fill located behind the front face of the structure, the modification method including the steps of arranging a second facing along the outer face of the first facing, disconnecting the stabilization element from the first facing, connecting the stabilization element to the second facing.

11 Claims, 8 Drawing Sheets

METHOD FOR MODIFYING A REINFORCED SOIL STRUCTURE

This Application is a 35 U.S.C. §371 National Stage Entry of International Application No. PCT/FR2011/053166, filed Dec. 22, 2011 and claims priority to French Patent Application No. 10 61210, filed Dec. 23, 2010, both of which are incorporated by reference in their entirety herein.

BACKGROUND OF THE INVENTION

The present invention relates to a method for modifying a civil engineering structure through reinforced soil techniques, such as for a structure with reinforced fill.

The structures concerned by the invention can be of various uses such as traffic lanes, extend a constructible space, prevent damage, erosion, or fall of wall stones or rock walls, or create an esthetic material.

A reinforced soil structure generally combines a compacted fill, a facing, and reinforcements or stabilization elements connected to the facing. The stabilization elements are placed in the soil with a density dependent on the stresses that might be exerted on the structure, the thrust forces of the soil being reacted by the soil-reinforcements friction.

The facing is most often made up of prefabricated concrete elements, in the form of slabs or blocks, juxtaposed to cover the front face of the structure. There may be horizontal steps on this front face between different levels of the facing, when the structure has one or more terraces.

The stabilization elements placed in the fill are usually secured to the facing by mechanical connecting members that may take diverse forms. Once the structure is complete, the stabilization elements distributed through the fill transmit high loads, in some cases of up to several tons. Their connection to the facing needs to be robust in order to maintain the cohesion of the whole.

Although these reinforced soil structures are very robust and capable of good performance, it can sometimes be realized that it is necessary to carry out changes to the structure.

For example, a structure initially designed to support four traffic lanes may need to be modified in order to permit the placement of six traffic lanes.

It may also be the case that over time the facing is degraded due, for example, to an initially unintended use of the structure or because of a construction defect of the facing.

The concrete facing elements can undergo concrete pathologies. Among the concrete pathologies known by the person skilled in the art which can lead to swelling of the facing elements, examples include alkaline reactions occurring within the concrete or internal sulphate reactions.

The internal swelling of crystals can lead to cracking followed by progressive breakdown of the concrete composing the facing. This swelling can take place over several months or several years. However, it is not detectable at the time of the production of the structure and this swelling may also be accelerated by unfavorable weather conditions.

The facing elements of a reinforced soil structure play an important role in the stabilization of the structure. Moreover, these facing elements also play an important architectonic role.

In the case of irremediable pathologies or facing element degradation, it may sometimes be necessary to restore the mechanical role of the facing by carrying out a repair.

Currently, the repair solutions essentially consist in replacing damaged or degraded facing elements.

The methods that are currently known by the person skilled in the art generally comprise the steps of:

stabilizing the fill by injection of concrete behind the facing element, cutting the facing element, removing it fragment by fragment, and casting a new facing element in place or replacing the old facing element by a prefabricated element.

The replacement of facing elements one by one is a long, meticulous process, presenting risks. In particular, it is necessary for large size structures to arrange a preliminary stabilization, for instance by injection of grout or resin in the fill material behind the facing elements. In fact, there is a risk of rock slide or erosion during the operation of withdrawal of the facing elements.

Therefore, there is a need for a method permitting to repair and/or modify a reinforced soil structure that does not have the shortcomings of the methods according to the prior art.

SUMMARY OF THE INVENTION

The invention therefore provides a method for modifying a reinforced soil structure, said structure comprising:

a fill, a first facing including an outer face defining the front face of the structure, and at least one stabilization element connected to the first facing and extending in a reinforced area of the fill located behind the front face of the structure, the modification method including the following steps of:

arranging a second facing along the outer face of the first facing, disconnecting the stabilization element from the first facing, connecting the stabilization element to the second facing.

Advantageously, the method according to the invention does not require removal of the facing elements. Therefore, the implementation of the method according to the invention does not present a risk of rock slide or erosion so that the operations are simplified and the safety is considerably improved.

Furthermore, a method according to the invention can include one or more of the following optional features, considered individually or in all the possible combinations:

disconnecting the stabilization element from the first facing is performed by opening from the outer face of said first facing, for example through sawing, percussion, or coring;

the method further comprises a step of placing a geotextile joint on the outer face of the first facing;

the method further comprises a step of placing a compressible material between the first and second facings;

the method further comprises a step of mechanically tensioning the stabilization element once the stabilization element is disconnected from the first facing;

the method further comprises a step of putting in place a maintenance system for the mechanical tension of the stabilization element before disconnecting the stabilization element from the first facing;

the second facing has substantially the same height as the first facing;

the second facing is placed against the first facing;

the second facing is placed along the outer face of the first facing in order to define a volume to be filled, the method further comprising a step of introducing filling material into said volume;

the second facing is placed along the outer face of the first facing in order to define a volume to be filled, the method further comprising the steps of:

introducing filling material into said volume, and compacting the filling material placed in said volume;

the first and second facings respectively comprise a first and a second assembly of prefabricated elements, the prefabricated elements of the first and second assemblies having substantially identical shapes and sizes and the prefabricated elements of the second assembly being placed according to a layout that is substantially identical to that of the prefabricated elements of the first facing; and/or the second facing includes a mesh to which the stabilization element is connected, the second facing element being then obtained by shotcrete.

The invention also relates to a reinforced soil structure modified through a method according to the invention.

BRIEF DESCRIPTION OF THE DRAWINGS

The invention will be better understood after reading the following description, only given as an example and with reference being made to the attached drawings in which.

DESCRIPTION OF EMBODIMENTS

For clarity reasons, the different elements represented on the figure are not necessarily drawn to scale.

Figure 1:
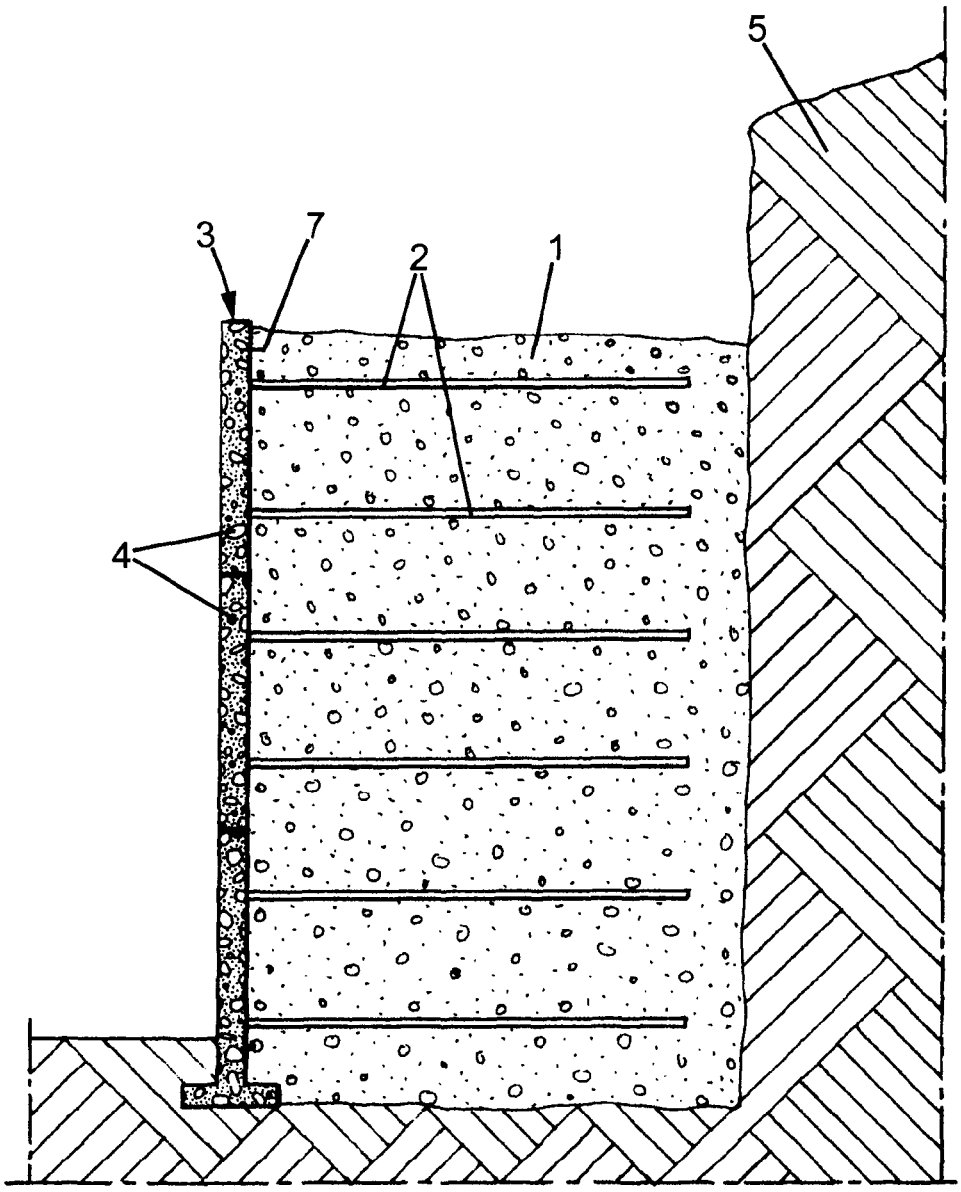
FIG. 1 is a schematic view in lateral section of a reinforced soil structure in the process of being built.

FIG. 1 illustrates a reinforced soil retaining wall. A compacted fill 1 in which stabilization elements 2 are distributed, is delimited on the front face of the structure by a first facing 3 formed by juxtaposing prefabricated elements 4 in the form of panels, and on the rear side by the soil 5 against which the retaining wall is erected.

In the example represented in FIG. 1, the stabilization elements 2 are linear elements such as rolled steel reinforcing members or geotextile strips.

The stabilization elements 2 may comprise metallic or synthetic reinforcing members, for instance in the form of flexible strips extending in the horizontal planes behind the first facing 3. These may in particular be reinforcement strips based on polyester fibers encased in polyethylene.

The stabilization elements 2 are anchored at the rear face of the facing elements 4, for example using hollow wall anchors, embedded anchors, nails or metallic rings, or any other anchoring mean known by the person skilled in the art.

Figure 2A:
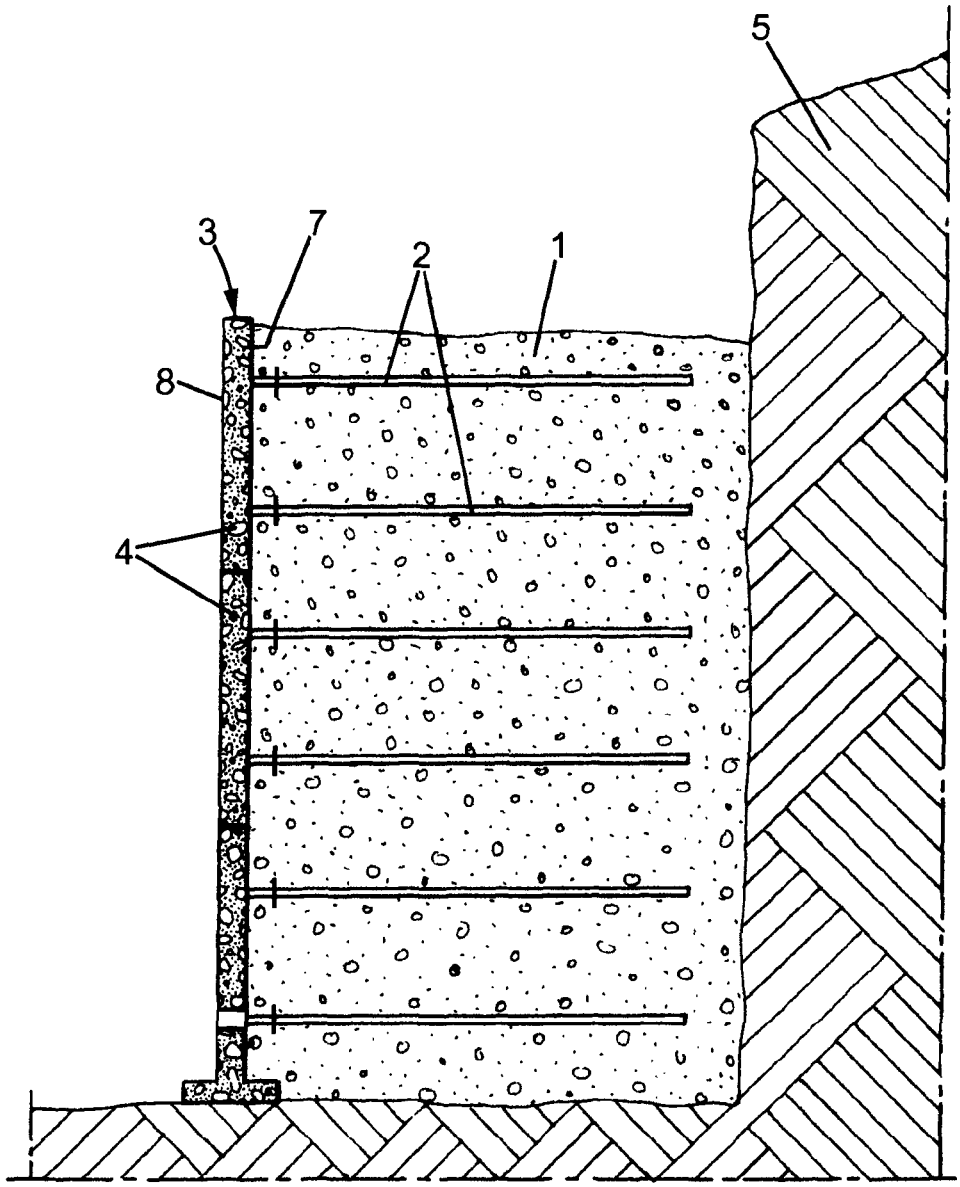
FIGS. 2*a* to 2*d* illustrate the placement of a second facing through a method according to a first embodiment of the invention.

According to a first embodiment, the method according to the invention permits the modifying of a reinforced soil structure in the same way as represented on FIG. 2*a*.

The method according to the invention may permit, for example, to enlarge the reinforced soil structure. This can present an interest, in particular if the reinforced soil structure support a roadway and it is desirable to enlarge this roadway.

This reinforced soil structure comprises a fill 1, a first facing 3 comprising an outer face 8 defining the front face of the structure. The first facing is composed of an assembly of first facing elements 4. The reinforced soil structure further comprises first stabilization elements 2 connected to the different first facing elements 4 and extending in a reinforced area of the fill 1 located behind the front face of the structure.

FIG. 2*a* illustrates a first step of the method according to the invention. During this first step of the method, at least one of the stabilization elements 2 connected preferably to the lowest facing is disconnected. To achieve this disconnection there can, for example, be performed a coring of the facing element 4 from the front face of the structure where the stabilization element is connected. Once this coring is performed, it is possible to disconnect the stabilization element from the facing element 4.

According to an alternative embodiment of the invention, tensioning may be applied on the stabilization element 4 using biasing members as disclosed in application FR 03 12083.

Figure 2B:
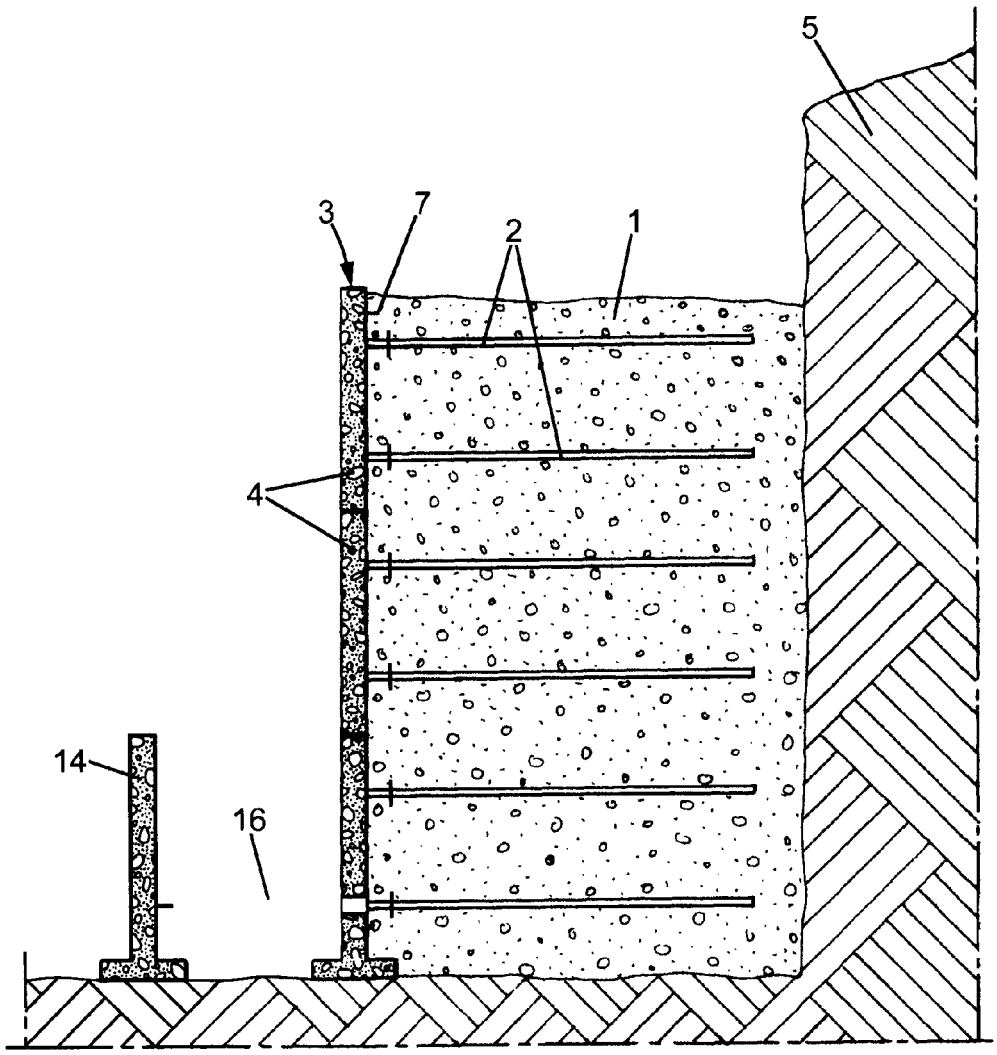

The method according to this first embodiment then comprises a step of placing a second facing illustrated on FIG. 2*b*.

During this step of placing a second facing, an element 14 from the second facing is fitted along the outer face of the first facing 4 in order to define a volume to be filled 16.

Figure 2C:
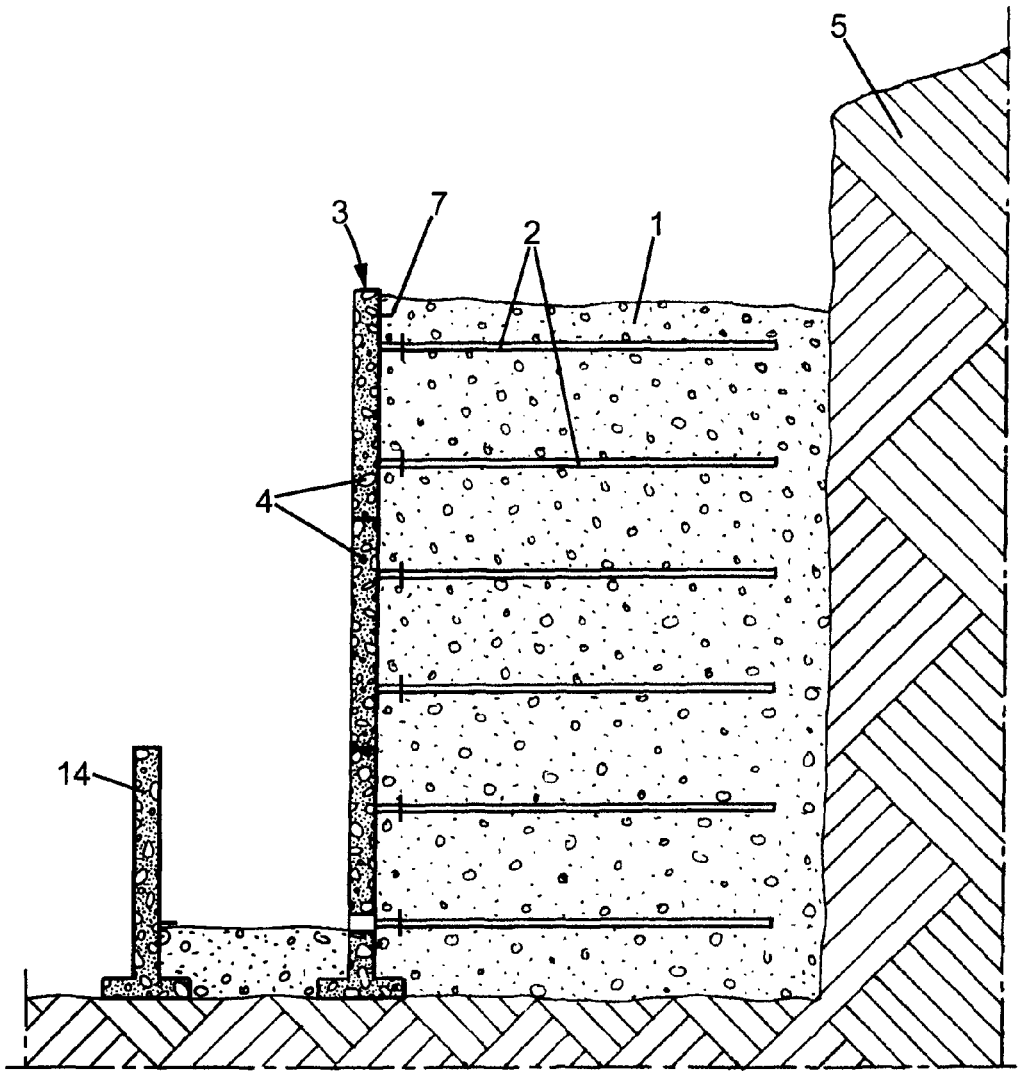

The method according to this first embodiment then comprised a step of filling illustrated on FIG. 2*c*.

During this step of filling, filling material is introduced and progressively compacted in the volume 16 defined between the first facing element 4 and the second facing element 14, until it reaches the level of the coring performed in the first facing element 4.

The materials that can be used as filling material include the natural soils, treated or stabilized soils through the use of lime or hydraulic binder, recycling material such as recycled concrete, road milled materials, some residues from industrial combustion or solid waste, etc.

Figure 2D:
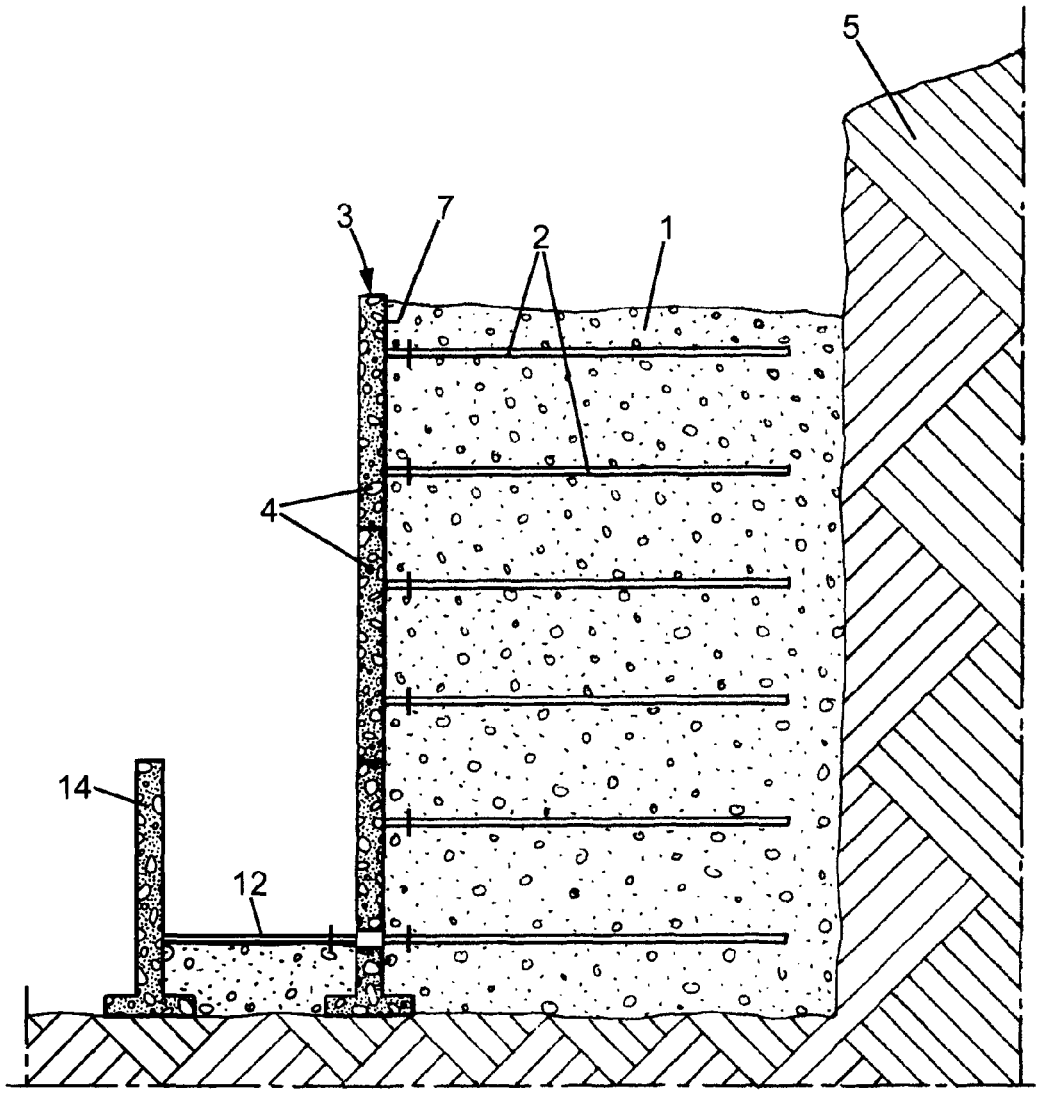

The method then comprises a step of placing a second stabilization element illustrated on FIG. 2*d*.

During this step of placing a second stabilization element, a stabilization element 12 is installed on the fill previously introduced and compacted. This second stabilization element 12 is connected to the first stabilization element 2, in order to form a new stabilization element comprising the first stabilization element 2 and the second stabilization element 12 connected one to the other.

The second stabilization element 12 may be connected to the first stabilization element 2 by any means of connection known by the person skilled in the art.

Filling material is then introduced over the second stabilization element 12 that has just been installed. This filling material is compacted as it is introduced.

The steps can be repeated as many times as needed if several stabilization element levels are placed in the reinforced soil structure to be modified.

According to an alternative embodiment of the invention, it is possible to apply tensioning on the new stabilization element comprising the first and second stabilization elements 2 and 12 after having connected the first and second stabilization elements one to the other. This tensioning can be achieved for example by using of a mechanical clamping device such as a tensioner.

According to a preferred alternative embodiment of the invention, the second facing element 14 has substantially the same shape and dimension as the first facing elements 4.

Favorably, this simplifies the implementation of the method and this confers to the reinforced soil structure flexibility properties substantially identical to that of the initial structure.

According to a second embodiment of the invention, the method according to the invention permits to repair a reinforced soil structure in which the facing elements might have been damaged.

Figure 3A:
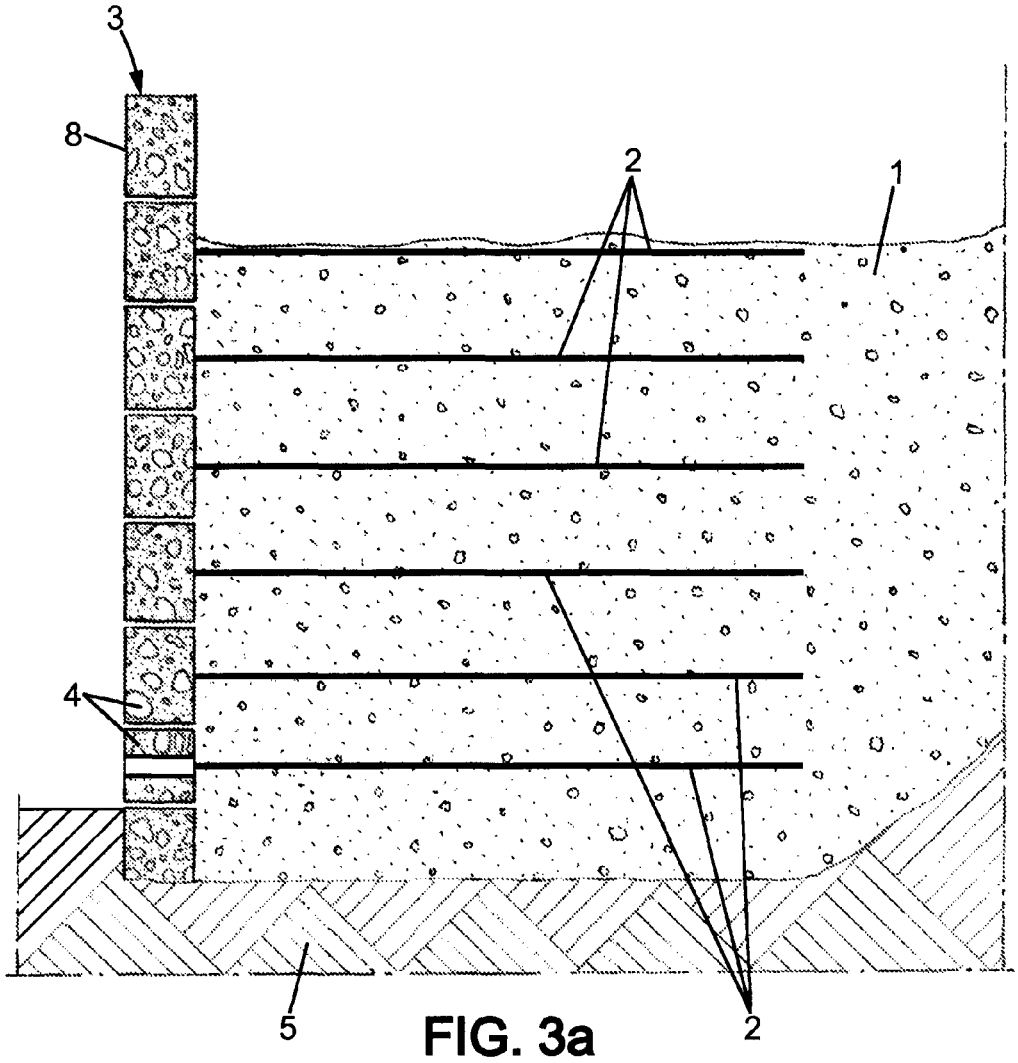
FIGS. 3*a* to 3*b* illustrate the placement of a second facing by means of a method according to a second embodiment of the invention.

According to the second embodiment of the invention, it is possible to repair the whole reinforced soil structure such as illustrated on FIG. 3*a*.

This reinforced soil structure comprises a fill 1, a first facing 3 comprising an outer face 8 defining the front face of the structure. The first facing being composed of an assembly of the first facing elements 4. The reinforced soil structure further comprises first stabilization elements 2 connected to the different first facing elements 4 and extending in a reinforced area of the fill 1 located behind the front face of the structure.

The method according to the invention permits to repair the structure without the need to replace the facing elements 4 one by one, hence avoiding a long, meticulous and risky process.

As illustrated in FIG. 3*a*, the method according to the invention comprises a first step in which a first stabilization element 2 connected to a first facing element 4 is disconnected, preferably one of the first facing elements located at the base of the reinforced soil structure.

This disconnection can be performed, for example, through an opening from the outer face of the first facing element 4, for example through sawing, percussion or coring. Following this disconnection, a second facing element 14 is placed along the outer face of the first facing element, preferably against the first facing element.

Figure 3B:
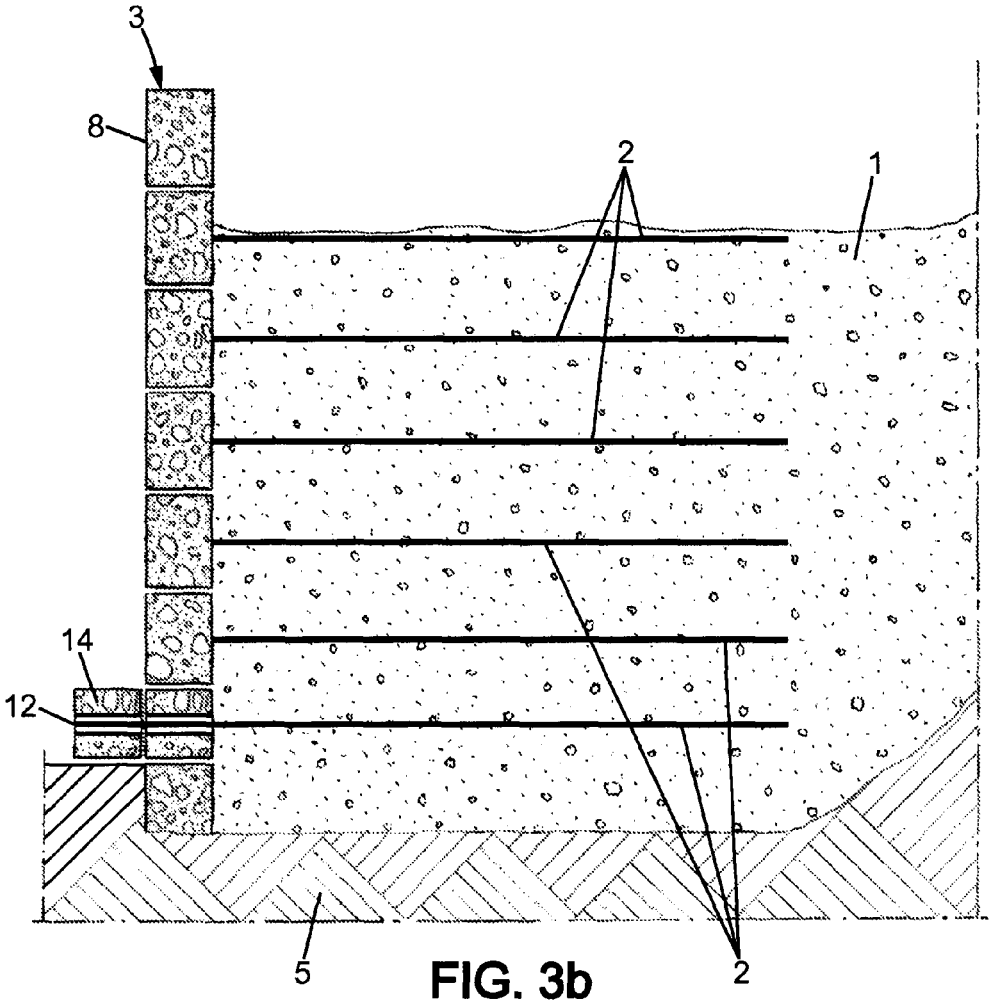

The first stabilization element 2 is then connected to the second facing element 14 as illustrated in FIG. 3*b*.

According to an alternative embodiment of the invention, the stabilization element 2 may be maintained in tension after the step of coring or applied tensioning once connected to the second facing element 14.

According to an alternative embodiment of the invention, the second facing element 14 may have anchoring means permitting to anchor the first stabilization element 2 to the second facing element 14 and mean of tensioning, such as a tensioner.

According to an alternative embodiment of the invention, it is possible, in order to avoid possible debris leak between the facing elements or fill leak between the joints, to put in place a complete geotextile joint on the front face of the structure to be repaired. This joint may also be placed in such a way as to cover the joint between the elements from the first facing; for example by sticking the layers of geotextile joints on the first facing.

According to an alternative embodiment of the invention, a compressible sheet, made of elastomer for example, may be placed between the first facing elements 4 and the second facing elements 14. In this case, a tensioning of the stabilization elements 2 before their connection to the second facing element 14 is facilitated. This alternative embodiment of the invention is particularly favorable when the first facing elements 4 risk continuing degrading with time, by swelling in particular.

According to an alternative embodiment of the invention, the new facing elements are substantially identical to the old facing elements and placed in a way that is substantially identical in comparison to the latter. Favorably, the implementation of the method is found simplified and this confers to the reinforced soil structure flexibility properties that are substantially identical to those of the initial structure.

Figure 4:
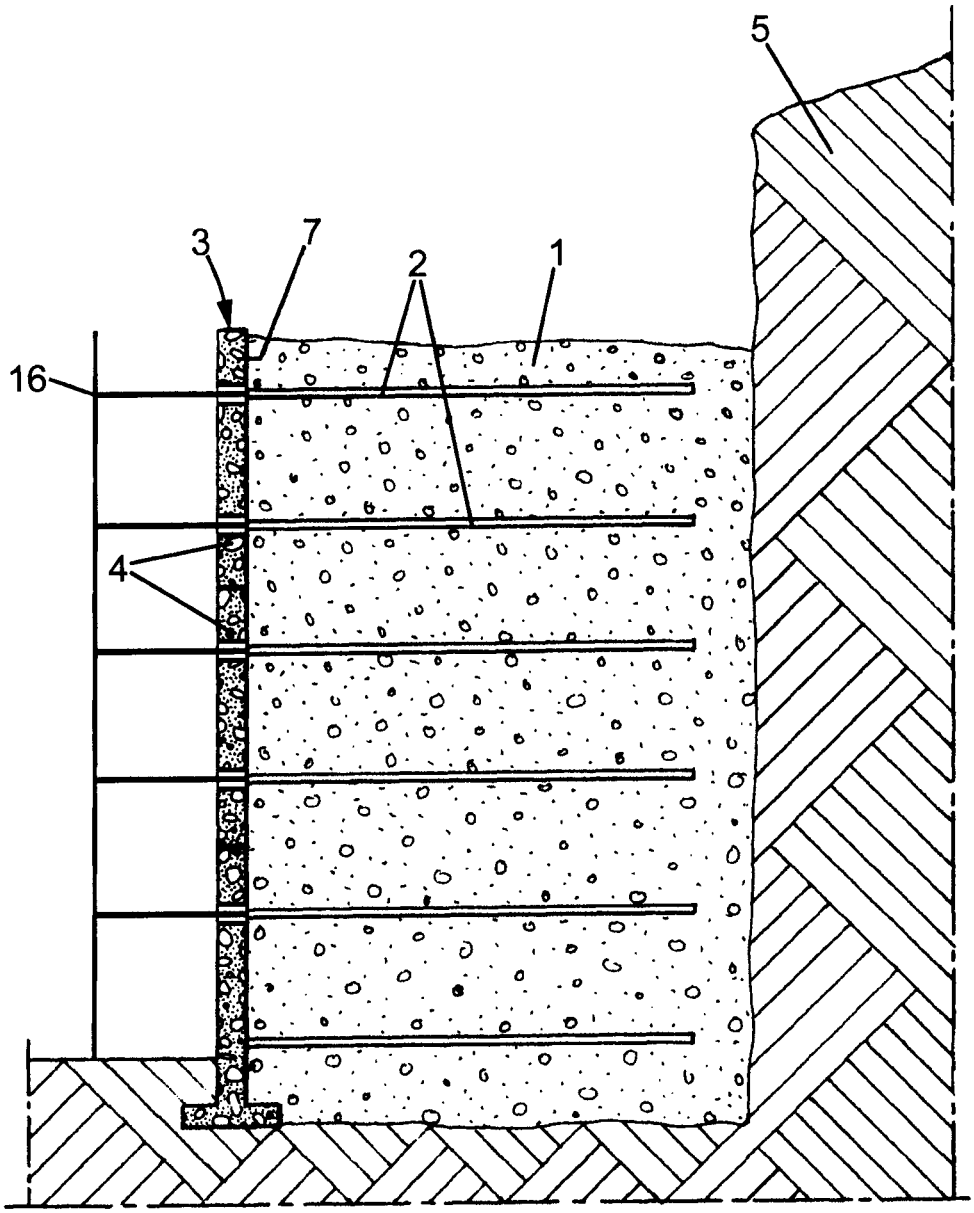
FIG. 4 is a schematic view in lateral section of a reinforced soil structure obtained by means of a method according to a third embodiment of the invention.

According to a third embodiment of the invention illustrated in FIG. 4, it is conceivable to place against the front face 8 of the reinforced soil structure a second facing comprising a mesh 16, metallic for example, wherein stabilization elements 2 will be connected. The second facing element is then formed using a shotcrete process on the mesh to which the stabilization elements 3 have previously been connected.

Shotcrete processes are well known to the person skilled in the art.

The invention does is not limited to the embodiments described and that have to be interpreted in a non-limiting manner, encompassing equivalent embodiments.

It is in particular possible to inverse the order of some steps of the particular embodiments described.

What is claimed is:

1. A method for modifying a reinforced soil structure, said structure comprising:

a fill;

a first facing including an outer face defining a front face of the structure; and at least one stabilization element connected to the first facing and extending in a reinforced area of the fill located behind the front face of the structure, wherein the modification method comprises:

arranging a second facing along the outer face of the first facing;

disconnecting the stabilization element from the first facing; and connecting the stabilization element to the second facing.

2. The method according to claim 1, wherein disconnecting the stabilization element from the first facing is performed by opening said first facing from the outer face, for example, through sawing, percussion, or coring.

3. The method according to claim 1, further comprising placing a geotextile joint on the outer face of the first facing.

4. The method according to claim 1, further comprising placing a compressible material between the first and second facings.

5. The method according to claim 1, further comprising mechanically tensioning the stabilization element once the stabilization element is disconnected from the first facing.

6. The method according claim 1, further comprising putting in place a maintenance system for the mechanical tension of the stabilization element before disconnecting the stabilization element from the first facing.

7. The method according to claim 1, wherein the second facing has substantially the same height as the first facing.

8. The method according to claim 1, wherein the second facing is placed against the first facing.

9. The method according claim 1, wherein the second facing is placed along the outer face of the first facing in order to define a volume to be filled, the method further comprising introducing filling material into said volume.

10. The method according to claim 1, wherein the first and second facings respectively comprise a first and a second assembly of prefabricated elements, the prefabricated elements from the first and second assemblies having substantially identical shapes and sizes and the prefabricated elements from the second assembly being placed according to a layout that is substantially identical to that of the prefabricated elements of the first facing.

11. The method according to claim 1, wherein the second facing includes a mesh to which the reinforcement element is connected, the second facing element being then obtained by shotcrete.

* * * * *